US011598049B2

(12) United States Patent
Ramires et al.

(10) Patent No.: US 11,598,049 B2
(45) Date of Patent: Mar. 7, 2023

(54) PROCESS OF PRODUCING NANOFIBRILLATED CELLULOSE WITH LOW ENERGY CONSUMPTION

(71) Applicant: SUZANO S.A., Salvador (BR)

(72) Inventors: Heloisa Ogushi Romeiro Ramires, Aracruz (BR); Braz José Demuner, Aracruz (BR)

(73) Assignee: SUZANO S.A., Salvador (BR)

( * ) Notice: Subject to any disclaimer, the term of this patent is extended or adjusted under 35 U.S.C. 154(b) by 408 days.

(21) Appl. No.: 16/464,259

(22) PCT Filed: Nov. 23, 2017

(86) PCT No.: PCT/BR2017/050355
§ 371 (c)(1),
(2) Date: May 24, 2019

(87) PCT Pub. No.: WO2018/094493
PCT Pub. Date: May 31, 2018

(65) Prior Publication Data

US 2019/0301094 A1 Oct. 3, 2019

Related U.S. Application Data

(60) Provisional application No. 62/426,058, filed on Nov. 23, 2016.

(51) Int. Cl.
*D21C 9/00* (2006.01)
*D21H 11/02* (2006.01)
(Continued)

(52) U.S. Cl.
CPC ..... *D21C 3/26* (2013.01); *D21C 5/005* (2013.01); *D21C 7/00* (2013.01); *D21C 9/007* (2013.01);
(Continued)

(58) Field of Classification Search
CPC ..... D21C 9/007; D21C 11/18; D21H 11/02; D21H 11/18
See application file for complete search history.

(56) References Cited

U.S. PATENT DOCUMENTS

2011/0277947 A1* 11/2011 Hua ..... D21H 21/10 162/28
2013/0000856 A1* 1/2013 Kajanto ..... D21H 11/18 162/141

OTHER PUBLICATIONS

Nanko et al., World of Market Pulp,2005, WOMP, p. 194-195. (Year: 2005).*

(Continued)

*Primary Examiner* — Anthony Calandra
(74) *Attorney, Agent, or Firm* — Morrison & Foerster LLP

(57) ABSTRACT

The present invention refers to the separation of cellulose pulp into distinct fractions with different draining and morphological characteristics, as well as the use of part of these fractions for the production of nanocellulose. The process in reference combines the unitary operations of fiber separation, thickening to a certain consistency, draining and drying of the cellulosic pulp with the high drainage ability and production of nanocellulose from high primary fines content pulp. The process may consider any cellulosic pulp fiber derived from short or long fiber woods such as Eucalyptus, Corymbia, Birch, Aspen, Pinus, recycled fibers, etc., their residues such as bark, sawdust, etc.

5 Claims, 13 Drawing Sheets

(51) Int. Cl.

| | |
|---|---|
| ***D21H 11/18*** | (2006.01) |
| ***D21C 3/26*** | (2006.01) |
| ***D21C 5/00*** | (2006.01) |
| ***D21C 9/10*** | (2006.01) |
| ***D21C 7/00*** | (2006.01) |

(52) U.S. Cl.
CPC ..... *D21C 9/10* (2013.01); *D21H 11/02* (2013.01); *D21H 11/18* (2013.01)

(56) References Cited

OTHER PUBLICATIONS

Gullichsen editor, Chemical Pulping 6A, 1999, Fapet Oy, p. 280-285. (Year: 1999).*
Guay et al., Comparison of Fiber Length Analyzers, 2005, Forest Products Lab; TAPPI Papermaking Conference (Year: 2005).*

* cited by examiner

PROCESS OF PRODUCING NANOFIBRILLATED CELLULOSE WITH LOW ENERGY CONSUMPTION

CROSS-REFERENCE TO RELATED APPLICATIONS

This application is a U.S. National Phase under 35 U.S.C. § 371 of International Application No. PCT/BR2017/050355, filed Nov. 23, 2017, which claims priority to U.S. Provisional Application No. 62/426,058, filed Nov. 23, 2016, the disclosure of each of which is hereby incorporated herein by reference in its entirety.

FIELD OF THE INVENTION

The present invention refers to the production of nanofibrillated cellulose and tailored pulp for high drainage ability with reduction in the energy consumption for both streams.

The process consists in the separation of a standard cellulose pulp into distinct fractions with different draining and morphological characteristics, as well as the use of one fraction to produce primary fines enriched pulp designated to nanofibrillar production and a high drainability pulp designated to paper market, containing Low primary fines content.

The process in reference combines the unitary operations of pulp cooking, bleaching, fiber separation, drying of the high drainage pulp fraction and thickening the high primary fines content pulp to a certain consistency so as to be able to proper nanofibrillating it.

BACKGROUND OF THE INVENTION

The production of cellulosic pulp involves several chemical and physical processes that result in the separation of the components of the wood raw material (usually composed of cellulose fibers and fibrils, hemicelluloses, lignin molecules and extractives or resins components).

Originally, there is broad size distribution of cellulosic particles in the above-mentioned raw materials associated with the anatomical structures, and part of it has reduced length.

During the processes, mechanical friction in equipments such as pressure reducers, pumps and stirrers which, in addition to the chemical embrittlement caused by cooking and bleaching liquors, causes the generation or increase of the content of these particles in the total resulting fibers. Those particles are named as primary cellulosic fines, being differentiated to any fine particles produced in papermaking process due to the fact that they never suffered the effect of any kind of refining, which are called secondary fines.

These fines produced in the pulping and bleaching process, along with the content of naturally occurring fines in raw materials, compose the total of particles present in the cellulosic pulp of which approximate dimensions are less than 200 micrometers in length.

The fines are defined as particles capable of linearly traversing sieves of which mesh is less than 200 (apertures of 74 micrometers) or which are less than 200 micrometers in length (TappiT261 cm 10, 2010—Fines fraction by might of paper stock by wet screening).

These particles have high specific area as well as high hydrophilic capacity, wherein their presence makes it difficult to drain the cellulosic paste in pulp and paper machines.

However, their small dimensions showed them to be a good starting material for the production of nanofibrillated cellulose, wherein the application of a cellulose paste enriched with fines for this purpose takes place with lower energy cost and or better quality potential when compared to the use of the standard cellulosic pulp.

The production of nanofibrillated cellulose consists of processing steps, wherein refining is the main treatment. But there are also combinations of refining treatments with chemical and/or enzymatic treatments. The energy consumption, however, is high due to the high refining energy consumption, and the cost of chemicals or enzymes for the production of nanofibrillated cellulose. Due to this problem it is important to develop new alternatives that can reduce energy consumption.

In this new process described herein, it was studied the potential of minimizing refining energy consumption by changing the raw material for the production of nanofibrillated cellulose. While most of the existing processes use regular (non-fractioned or segregated) cellulose pulp for the production of nanofibrillated cellulose, in this new process it is defined a process for fractionating the original cellulose pulp to obtain a fraction rich in primary fines and shorter fibers, which is then the base raw material for the production of nanofibrillated cellulose.

International application WO 2013/188657 A1, published on Dec. 19, 2013, entitled "Energy efficient process for preparing nanocellulose fibers", describes a process that combines mechanical treatment (refining) with chemical (ozone) and/or enzymatic treatment. The described process is directed to increase energy efficiency, which is measured by the depolymerization degree of the pulp and by the refining energy consumption to reach a certain level of secondary fines (reaching a very high level of fines is not a starting pulp material but a way to define the quality of the nanocellulose obtained after the refining process, generating high amount of secondary fines). The described process is based on initiating from an original common cellulosic pulp, winch is composed of fibrous elements and not segregated or fractionated. At no time the raw material for producing nanofibrillated cellulose is a source of primary fines type elements associated with separation of pulp phases, contrary to what is proposed in the process described herein.

Another method of producing nanofibrillated cellulose is described in International application WO 2015/171714, published on Nov. 12, 2015, entitled "High efficiency production of nanofibrillated cellulose". Different from the present invention, this document describes refining treatments of the cellulosic pulp in its original form (and not in the form of primary fines enriched pulp). The method consists of the treatment of the pulp in two steps, wherein the first step is conducted with refining elements different from those used in the second step.

International application WO 2015/171714, published on Nov. 12, 2015, entitled "Cellulose fibers, nanofibrils and microfibrils: the morphological sequence of NFC components from a plant physiology and fiber technology of view", also describes the dimensions of micro and nanofibrillated celluloses produced from original common pulp, and not the benefits from generating a new and unique starting material.

International application PCT/FI2010/050897, published on Nov. 24, 2009, also describes the high refining energy consumption in the production of nanofibrillated cellulose and presents the use of a bleaching agent (as an additive), but it does not describe, at any time, the use of primary fines enriched pulp as raw material in place of non-fractioned cellulose.

International application WO 2014/106684 also discloses the high energy consumption in the production of microfibrillated cellulose and presents a solution with combinations of processes by alternating refining and washing, thus obtaining an increase in consistency to minimize energy consumption.

International application WO 2014/085730, published on Jun. 5, 2014, provides a method of fractionating bi mass into different chemical components and cellulose. The fractionation mentioned herein refers to the separation of the biomass components: cellulose, from lignin and hemicelluloses, and therefore, it does not have any similarity with the present invention. The use of the cellulose extracted is the production of nanocrystalline cellulose, which is not an object of the present invention either.

The research paper published by Osong, S. 2013, et al, titled "An approach to produce nano-ligno-cellulose from mechanical pulp fine materials", published on pages 472-479 from Nordic Pulp & Paper Research Journal (NPPRJ), Volume 28, describes a study in which mechanical pulp is separated and the shorter particles are directed to nano-ligno-cellulose production through homogenization. It totally differs from the present invention considering the initial raw material (mechanical pulp) and even more in the final product produced: nano-lignin-cellulose, due to the high contents of lignin in its composition. Also, the type of processing is different, it being performed through homogenization and not through refining energy application.

The refining mechanical treatment is, in general, the most commonly used process for generation of nanofibrillated cellulose, which results in significant changes in the morphological characteristics. The publications know from the state of the art, although mentioning fines as secondary fines, are only those generated during the refining treatment, whereas in the present invention the fines are in its totality primary fines, fractionated from an original cellulose, thus being the raw material for the production of nanofibrillar cellulose.

SUMMARY OF THE INVENTION

It is an object of the present invention to provide a process of producing nanofibrillated cellulose with Low energy consumption and also a high drain ability market pulp comprising the steps of:

a) cooking and bleaching of biomass, generating a mass rich in cellulosic and hemicellulosic polymer chains, comprising very reduced amount of lignin and extractives.

b) selecting and directing a cellulosic material from a fiber line having the following characteristics:

b. 1) average fiber length: 0.3 to 2.5 mm and b. 2) primary fine content: 3% to 30% of fines by mass;

c) fractionating the selected material by means of a fractionating system d) separating one stream with the high-primary fines content material fraction obtained in step c), in a per range from 10% to 90% of primary fines and consistencies of 0.02% to 1% e) thickening of this stream until consistencies of 2% to 15% f) submitting the thickened material to a nanofibrillated cellulose production process, wherein it is subjected to mechanical refining energy, being the energy consumption used for the generation of the nanofibrillar cellulose smaller than in comparison with common cellulosic pulp starting material.

g) separating the other fraction stream with lower primary fines content, so called high drainage pulp, presenting a massic amount of fines of about 3 to 8% with significant lower resistance to drainability and water retention value, presenting a °SR reduction of 15% to 50% water retention value reduction between 7% and 35; and h) drying of the Low primary fines content pulp in drying pulp machines with lower consumption of drying energy, this reduction typically being between 2% and 10% in total energy when compared with the energy used to dry common pulp.

BRIEF DESCRIPTION OF DRAWINGS

The structure and operation of the present invention, together with further advantages thereof nay be better understood by reference to the accompanying drawings and the following descriptions:

FIG. 12(*a*) shows a comparison of tensile strength of a standard pulp added with nanofibrillar cellulose in order to evaluated the quality of the nanofibrillar cellulose in terms of tensile strength generation in a given pulp, showing that in terms of quality of nanofibrils generated all pulps were similar.

FIG. 12(*b*) shows a comparison of resistance to drainage of a standard pulp added with nanofibrillar cellulose in order to evaluated the quality of the nanofibrillar cellulose in terms of Schopper Riegler degree increment generation in a given pulp, showing that in terms of quality of nanofibrils generated all pulps were similar.

DETAILED DESCRIPTION OF THE INVENTION

Figure 1:
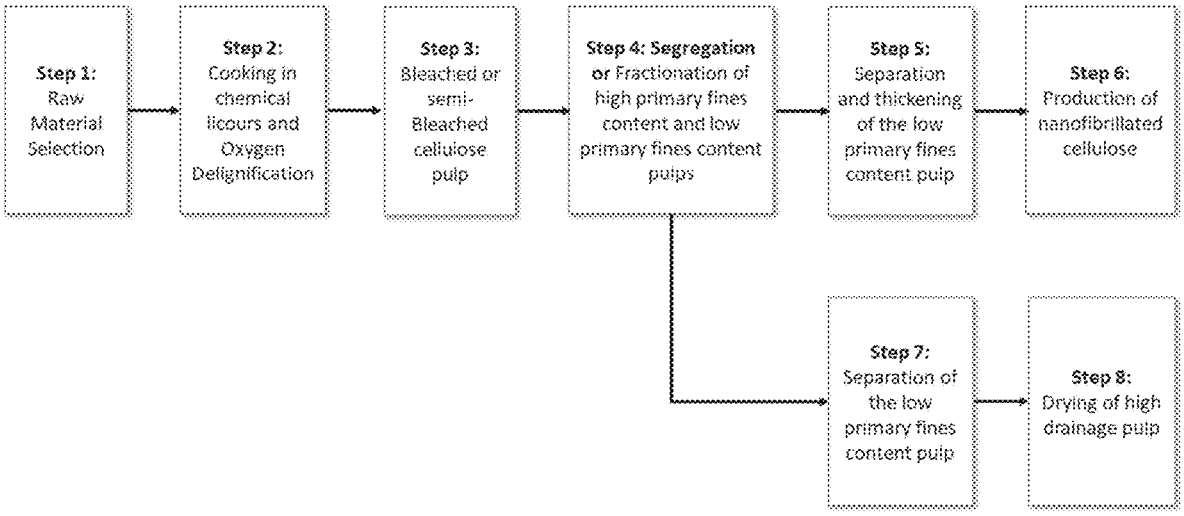
FIG. 1 illustrates a simplified scheme of obtainment of products from this invention: nanofibrillar cellulose and high drainage pulp for paper making.

Although the present invention may be susceptible to various embodiments, there are show in the drawings and in the following detailed discussion, preferred embodiments with the understanding that the present disclosure is to be considered as an exemplification of the principles of the invention and is not intended to limit the present invention to what is illustrated and described herein.

The present invention refers to a process of producing nanofibrillated cellulose with lower energy consumption, and a pulp with high drainage ability. The energy consumption set herein is based on the sane treatment performed on a reference (standard or common) pulp, compared to different level s of tri al pulps according to what is proposed in the present invention.

The energy consumption reduction is possible with the production of a raw material of cellulose primary fines obtained by fractionating of cellulose pulp, followed by a refining treatment.

Although the nanofibrillated cellulose production process involves a similar unitary operation, the present invention refers to the new use of pre-fractionated raw material combined with unique process parameters for the production of cellulosic material having nanometric dimensions with significant reduction of energy consumption.

The preferred embodiment of this invention relates to a process of producing nanofibrillated cellulose with Low energy consumption comprising the steps of:

a) cooking and bleaching of biomass, generating a mass rich in cellulosic and hemicellulosic polymer chains, comprising very reduced amount of lignin and extractives.
b) selecting and directing a cellulosic material from a fiber line having the following characteristics: b. 1) average fiber length: 0.3 to 2.5 mm and b. 2) primary fine content: 3% to 30% of fines by mass;
c) fractionating the selected material by means of a fractionating system
d) separating one stream with the high-primary fines content material fraction obtained in step c), in a percentage range from 10% to 90% of primary fines and consistencies of 0.02% to 1%
e) thickening of this stream until consistencies of 2% to 15%
f) submitting the thickened material to a nanofibrillated cellulose production process, wherein it is subjected to mechanical refining energy, associated or not with enzymatic treatment, being the energy consumption used for the generation of the nanofibrillar cellulose smaller than in comparison with common cellulosic pulp starting material.
g) separating the other fraction stream with lower primary fines content, so called high drainage pulp, presenting a massic amount of fines of about 3 to 8% preferably between 4% and 7% with significant lower resistance to drainability and water retention value, typically presenting °SR reduction of 15% to 50% more preferable between 20% and 40% water retention value reduction between 7% and 35% more preferable between 10% and 25%
h) drying of the Low primary fines content pulp in drying pulp machines with lower consumption of drying energy, this reduction being typically between 2% and 10% in total energy when compared with the energy used to dry common pulp.

In step a), the cellulosic material is selected from cooked materials, and maybe bleached cellulose, semi-bleached cellulose, unbleached cellulose, recycled fibers and combinations thereof.

The process may consider any cellulosic pulp fiber derived from short or long fiber mods such as Eucalyptus, Corymbia, Birch, Aspen, Pinus, etc., their residues such as bark, sawdust, etc., and also any type of recycled fibers, preferably of Eucalyptus and Corymbia genders.

The pre-selected materials then fractionated in step b) preferably through a fractionating system but not limited to pressurized basket screening systems, fines particulate recovering washers or hydrocyclones, in one or more steps, wherein combinations of the aforementioned equipment may be used.

The high-primary fines material fraction obtained from step b) is then subjected to thickening and nanofibrillar cellulose production process, in which it will be subjected to refining energy so that its element sizes are reduced to nanometric fractions.

The fraction of fibers with lower primary fines content, containing a massic amount of fines of about 3 to 8% preferably between 4% and 7% with significant lower resistance to drainability and water retention value.

In step d), the high primary fines content pulp is characterized by °SR between 20 and 95; and water retention values between 140 and 690 percent.

In step g), the absolute variables specific from Eucalyptus treatments in the High Drainage Pulp after pulp dryer are: fines content between 3% to 8.5% preferably between 4 to 7% water retention value between 90 and 140 g/g, more preferable between 110 and 130 and °SR between 12 and 19, more preferable between 14 and 17.

FIG. 1 describes briefly the processual steps from raw material selection until the production of the Nanofibrillated cellulose and the high drainage pulp.

Figure 2:
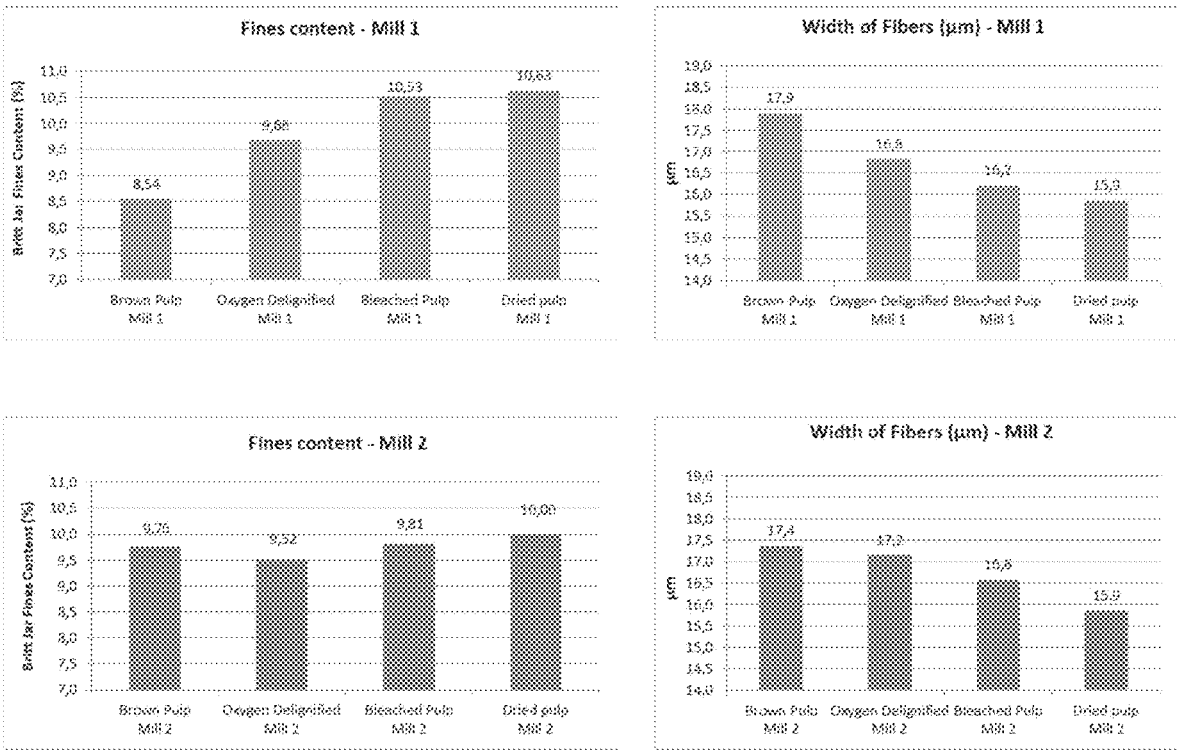
FIG. 2 shows examples of the evolution of fines formation (measured by Britt Jar) and width of fibers (measured by optical morphology) in kraft pulp mills.

FIG. 2 describes the increase in the fines content in two different kraft mills, showing the crescent profile of fines content according to the course of the process. The profile may be slightly different case by case for each mill due to the kind of equipments, intensity of cooking and mechanical energy suffered by the fibers.

Likewise, the width of the fibers also decreases due to the chemical peeling reactions also contributing to the increase and generation of the fiber category so called primary fines.

Figure 3:
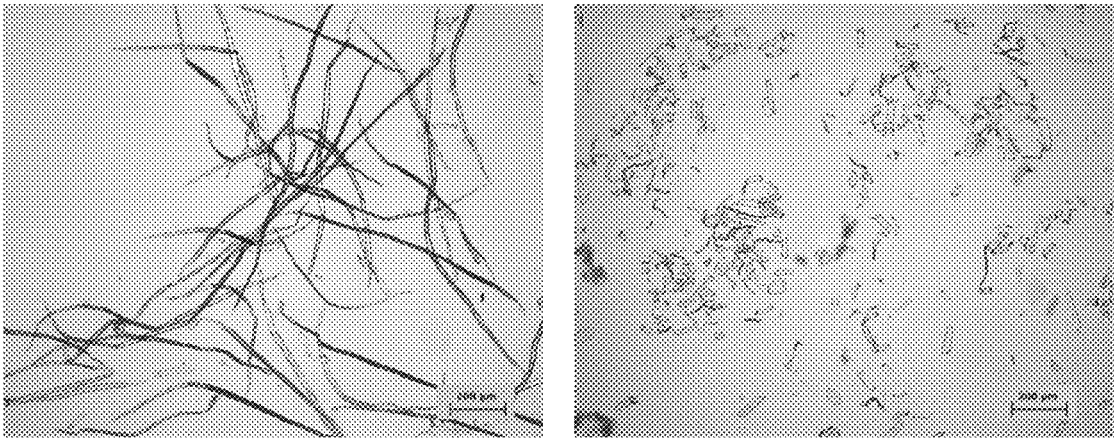
FIG. 3 shows the characterization of the fines material present in the pulp samples (Low fines content and high fines content) in extreme conditions.

FIG. 3 shoes the microscopic aspect of the fibers (in the right) and primary fines (in the left). A high amount of short fibers and small elements is present in the primary fines sample and barely seen in the samples whose material was removed, allowing the high drainability of the pulp trough physical and chemical improved flow through the void volumes Created.

Figure 4:
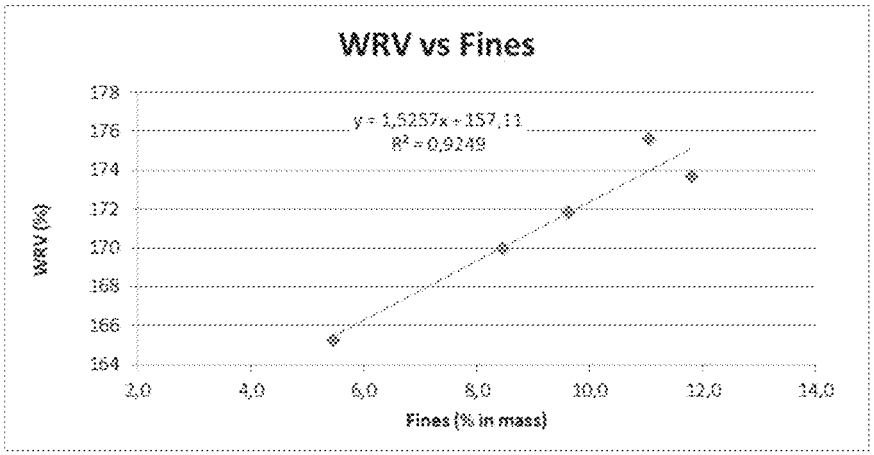
FIG. 4 illustrates the impact of the fines in drainability of pulp in lab conditions.
Figure 4:
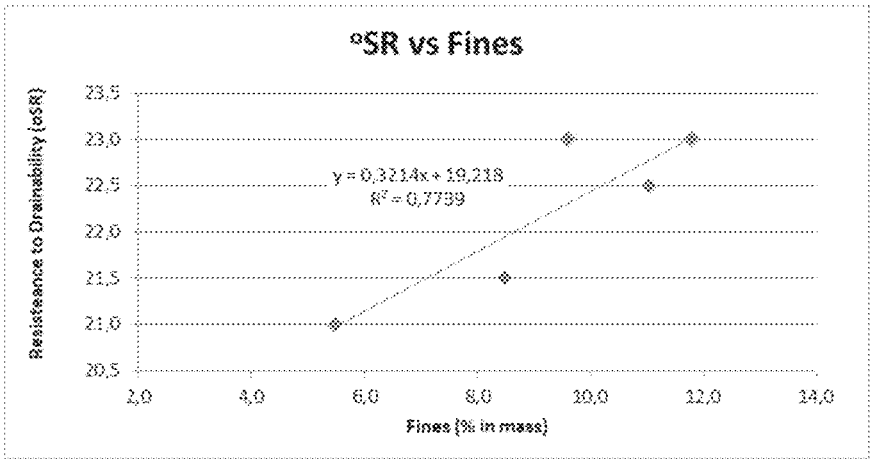

FIG. 4 shows the impact of the primary fines (measured by Britt Jar in mass percentage) in drainability aspects represented by Schopper Rigler degree (°SR) and water retention value. The values clearly indicates the high impact of the presence of primary fines in the drainability of the fibers.

Figure 5A:
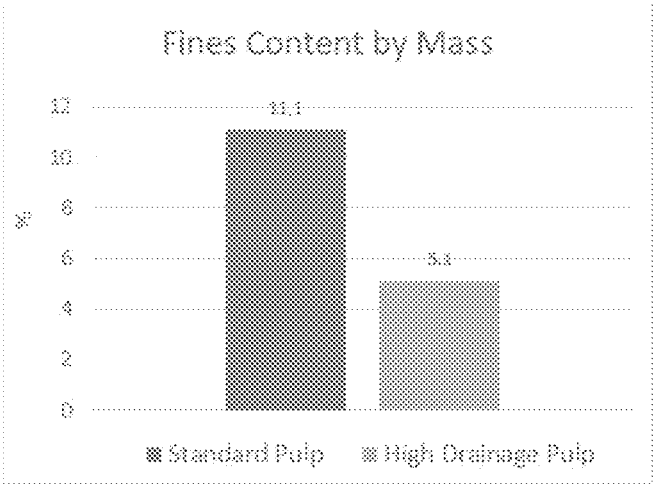
FIG. 5(*a*)-(*c*) shows a morphological characterization of processed pulp with lower fines content, showing its properties and uniqueness in terms of primary fines content, with increase in general fiber length and width of fibers.
Figure 5B:
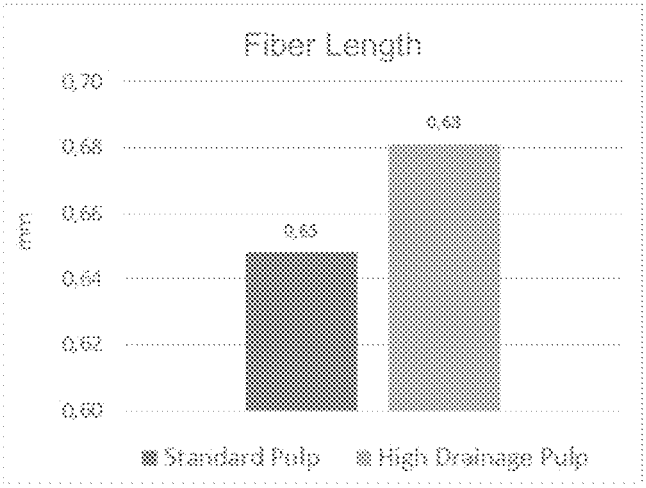
Figure 5C:
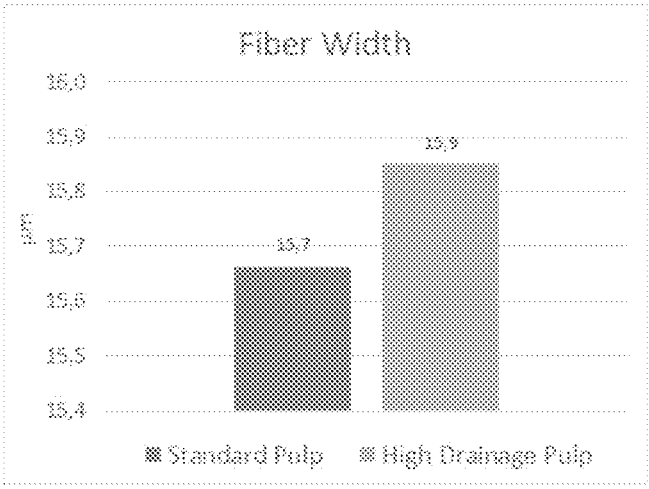
Figure 6A:
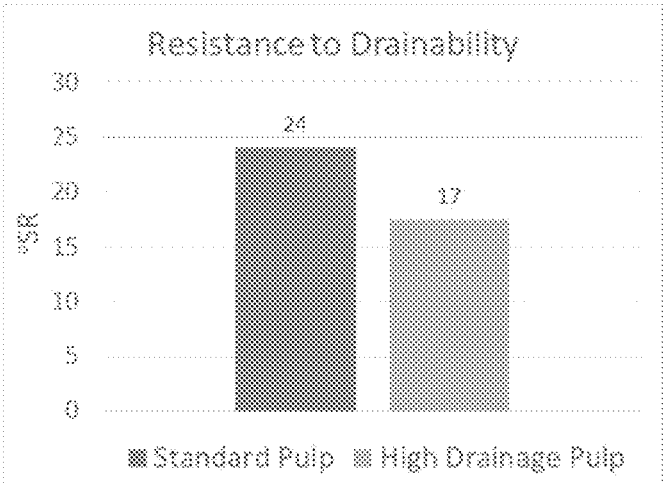
FIG. 6(*a*)-(*d*) illustrates the characterization of pulp generated in pilot scale with lower fines content, so called high drainage pulp in terms of resistance to drainage (°SR), water retention value, bulk and water absorption of a never dried Eucalyptus pulp.
Figure 6B:
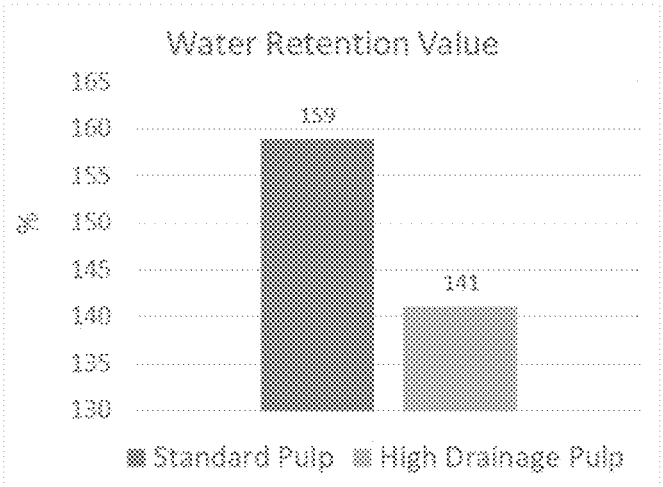
Figure 6C:
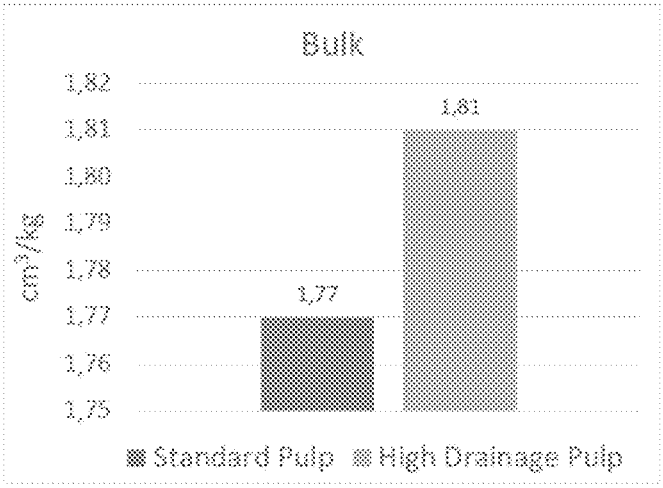
Figure 6D:
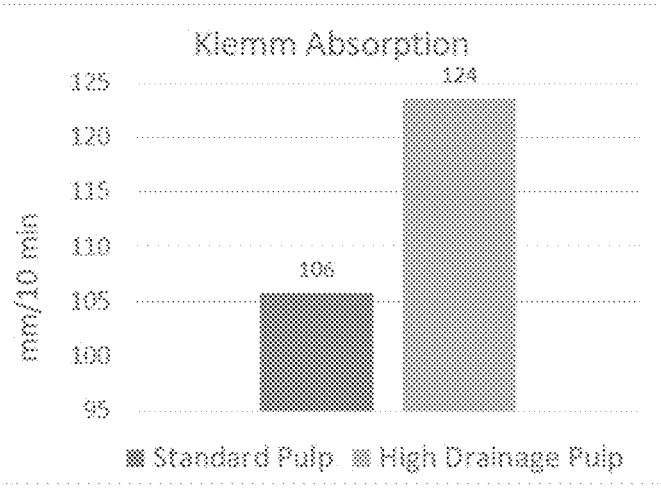

FIG. 5 shows the morphological characteristic of the high drainage pulp, with reduced primary fines content to its half, and increase of fiber length and width.

FIG. 6 show the drainability and absorption properties characterization of pulp generated in pilot scale with lower fines content. The properties of the so called High drainage pulp in terms of resistance to drainage (OSR), water retention value, bulk and water absorption demonstrates that considerable gains in the drainability properties are present, signifying high potential for energy consumption reduction in the drying of this pulp in pulp and paper machines. The absence of fines also creates higher bulk pulp, allowing the pulp to absorb more eater per gram of pulp.

Figure 7:
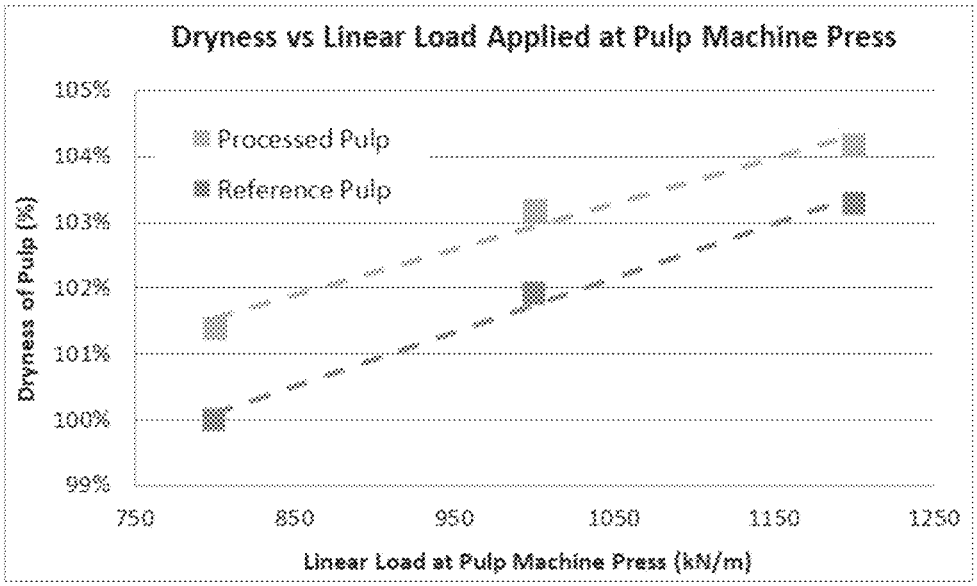
FIG. 7 illustrates a pilot plant trial data showing the gains in dryness after press with High Drainage pulp containing reduced primary fines content, and showing the increase in the dryness content for the treated (high drainage) pulp. The dryness is a direct measurement for energy consumption. The higher the dryness, the smaller the energy consumption to dry a pulp in a pulp machine.

FIG. 7 shows the possible gains in dryness after pulp machine press, allowing the energy saving in between 2 to 10% for pulp drying.

Figure 8:
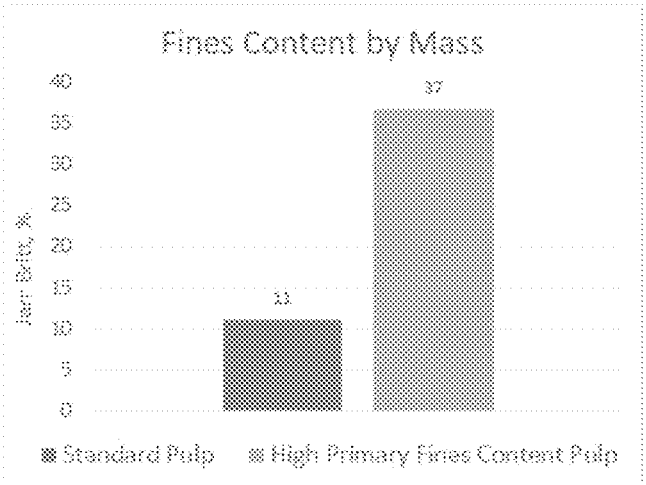
FIG. 8(*a*)-(*e*) shows the characterization of high fines content pulp, generated through pi I of process, considering its morphology and drainability characteristics.
Figure 8B:
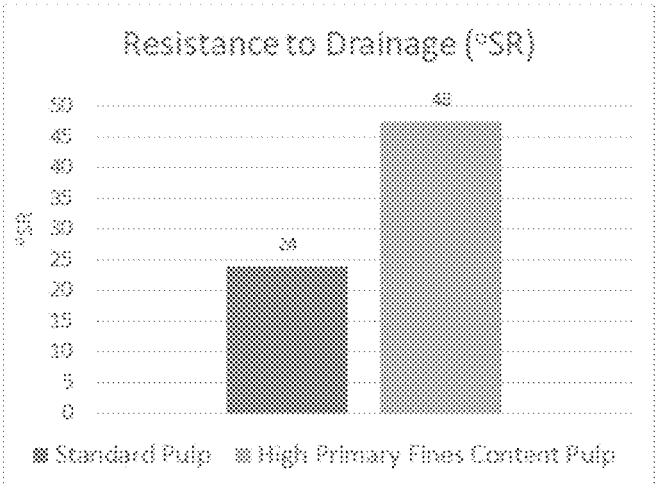
Figure 8C:
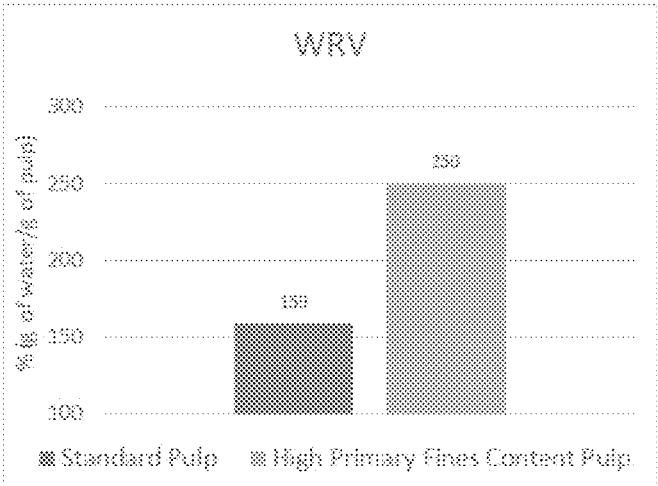
Figure 8D:
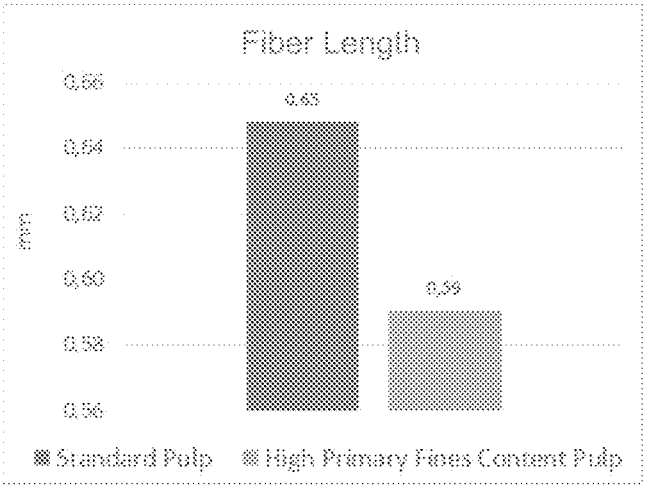
Figure 8E:
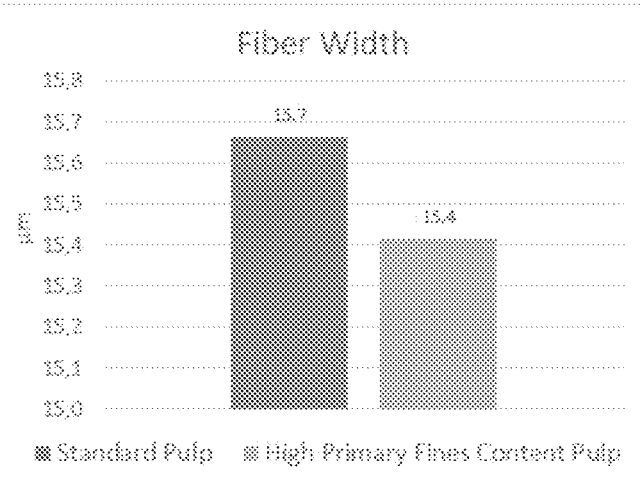

FIG. 8 shoves the properties of the high primary fines content pulp, generated through pilot processes. In FIG. 8-*a*), the primary fines content show has values obtained from one of the conditions used in pilot trials, and can be higher or lower depending of the need and technology set up used. The impact on drainability as demonstrated in item b and c is enormous, showing very high drainage and voter retention values caused by the presence of the primary fines in the pulp. The items d and e show the average fibers length and width measured, demonstrating that the fibers contained in the materials are also shorter and narrower that the regular ones.

Figure 9:
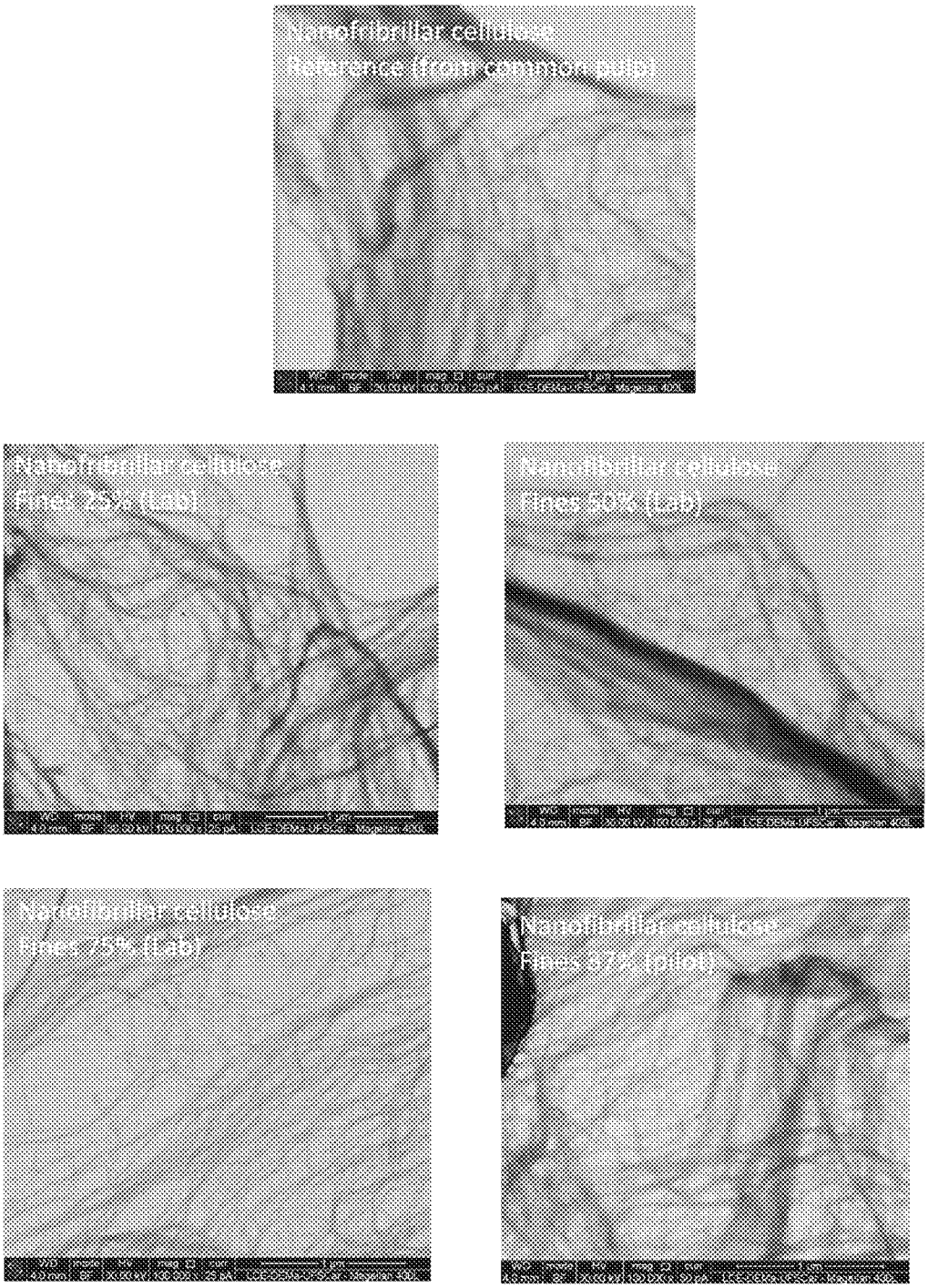
FIG. 9 shows high resolution microscopy of nanofibrillar cellulose based on 4 different types of pulps, obtained in lab: Reference or Standard common pulp; High primary fines content pulp with 25% primary fines in mass; High primary fines content pulp With 50% primary fines in mass; High primary fines content pulp with 75% primary fines in mass; pilot trial High primary fines content pulp with 37% showing that all samples were able to generate nano dimensions in the final nanofibrillar material.
Figure 10:
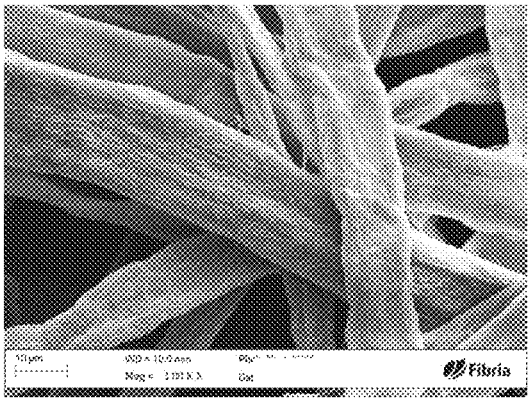
FIG. 10 shows a picture in scale of standard cellulose fibers, for reference in comparison with the nanofibrillar cellulose. It is to be noted that the scale is 10 times higher than that shown in FIG. 9.

FIG. 9 shows examples of images showing the width of the nanofibrils generated from increasing primary fines content samples.

Figure 11:
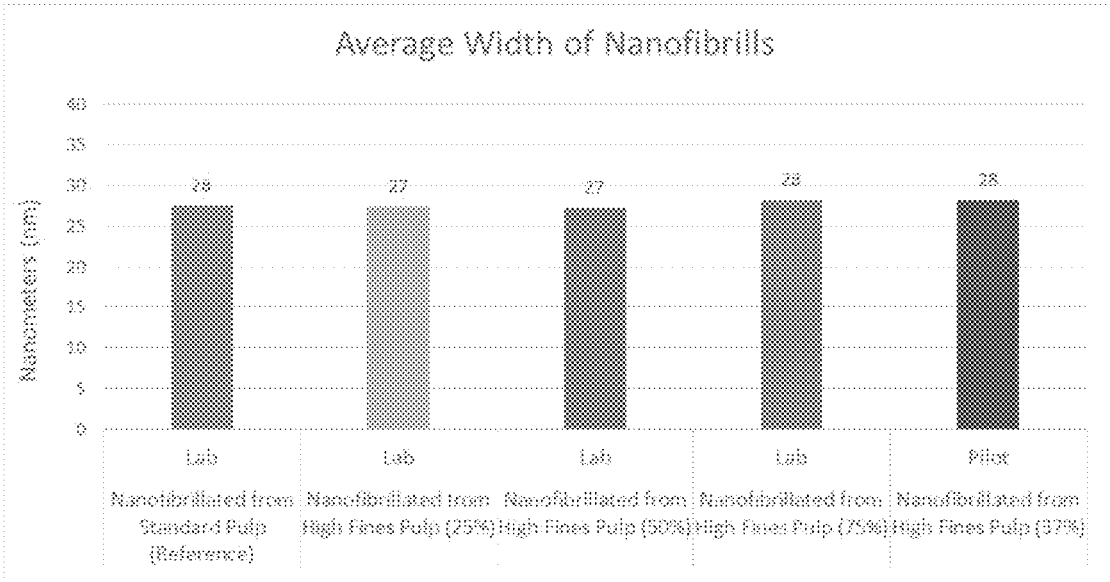
FIG. 11 illustrates the average of the width of nanofibrils from different primary fines content samples, including the High Fines Content Pulp generated in pilot conditions, showing that all the Nanofibrillar celluloses generated have similar width of nanofibrils average.

The average of its width vas done by evaluating 400 measurements for each sample, from at least 10 high resolution images and resulted in very similar width for all the samples, showing that the quality of the nanofibrillated cellulose is the sane, as seen in FIG. 11.

Figure 12A:
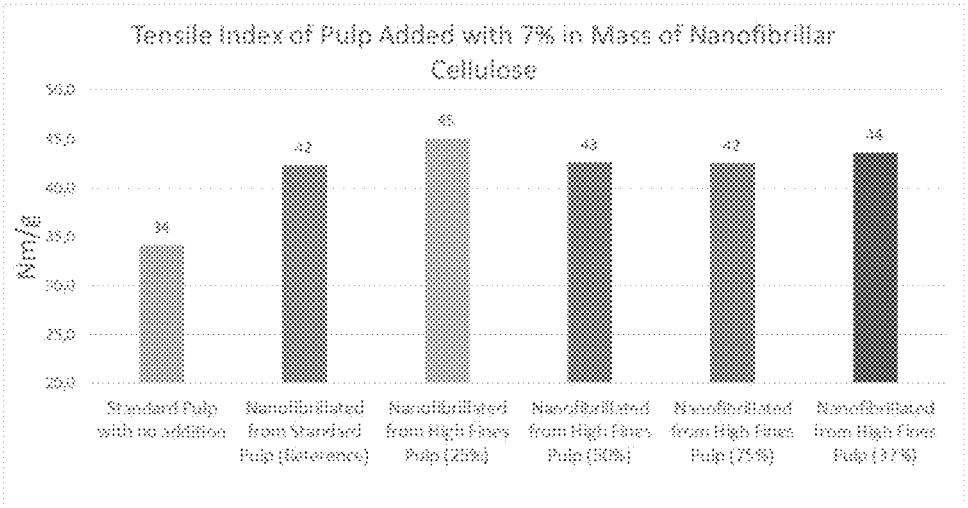
Figure 12B:
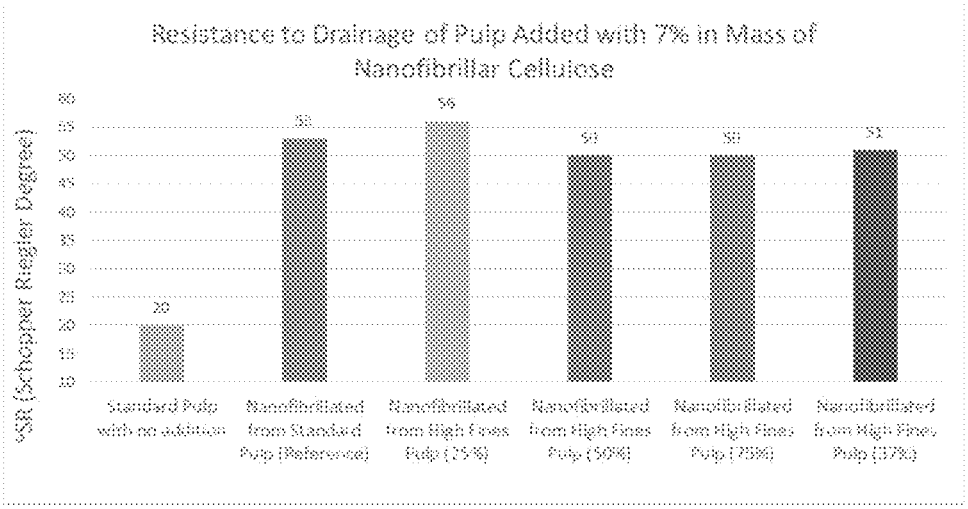

FIG. 12 shows the characterization of the potential of modifying properties in a given standard pulp by adding Nanofibrillar cellulose in terms of tensile Strength and Resistance to drainage increase.

As can be seen from FIG. 12, there is no difference between the quality of the nanofibrillated cellulose generated from standard pulp and from the high primary fines content pulp.

Figure 13:
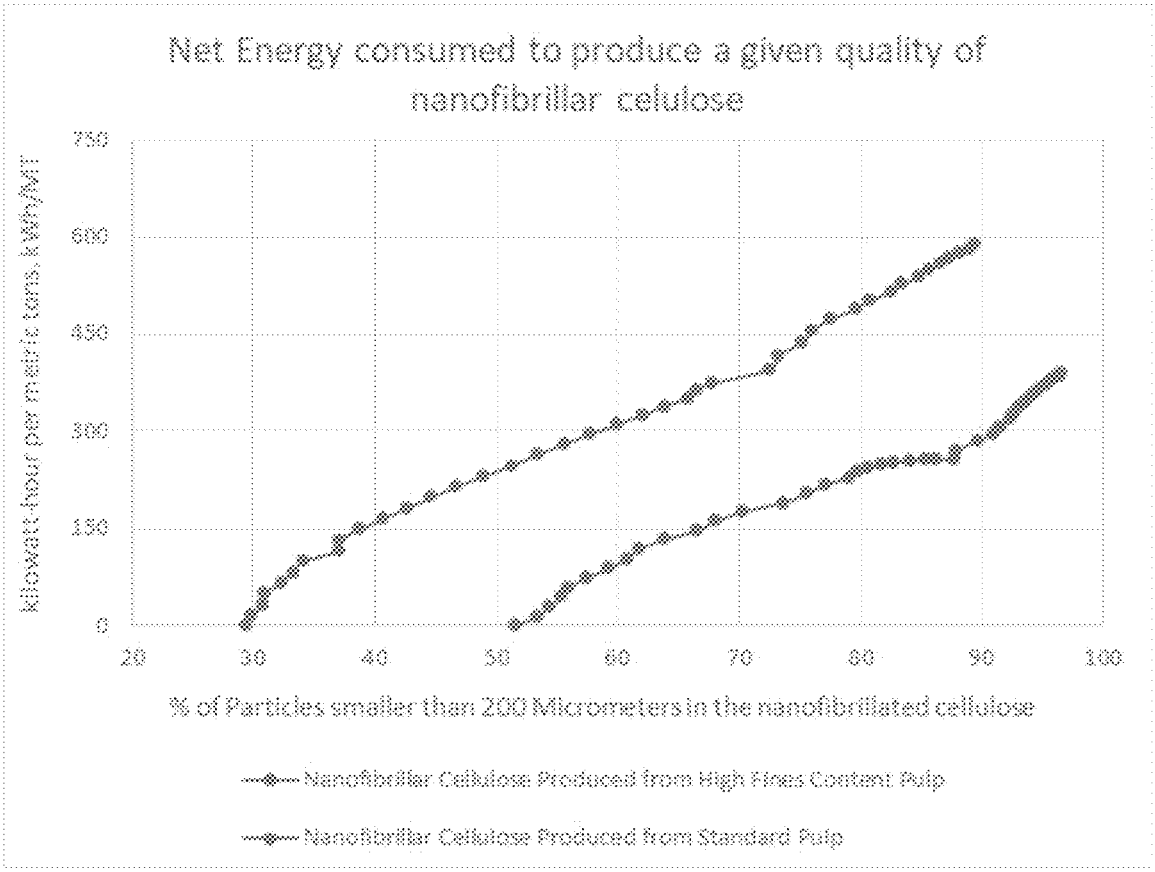
FIG. 13 illustrates the energy consumption in kWh per metric ton consumed to generate a given quality of nanofibrillar cellulose in a pilot plan with capacity to produce 2 tons per day, showing a significant decrease in the energy consumption when using the high primary fines content pulp as starting material for the nanocellulose production.

FIG. 13 shows the energy consumption in kWh per metric ton consumed to generate a given quality of nanofibrillar cellulose in a pilot plan with capacity to produce 2 tons/day. By convention, and based on literature and machine construction for nanocellulose obtainment trough refining energy (please see reference WO 2013/188657) when 90% of the particles size in length is smaller than 200 micrometers, obtained in morphological measurements, the product can be considered a nanofibrillated cellulose according to the definition of having at least one of its three dimensions between 1 and 100 nanometers according to ISO/TS 20477: 2017—Nanotechnologies Standard terms and their definition for cellulose nanomaterial.

In the chart 13, it is shown that the energy necessary to the obtainment of high quantity of smaller particles is much lower than the standard pulp. Considering the standard value of 90% the total net energy reduces to its half. It is possible also to see that if necessary, the application of energy can be such that the quality of the nanofibrillated celullose can be increase (through the increase of the amount of fibers in smaller size than 200 micrometers).

Thus, although only some embodiments of the present invention have been shown, it will be understood that several omissions, substitutions and changes can be made by a person skilled in the art, without departing from the spirit and scope of this invention. The embodiments described should be considered in all respects only as illustrative and not in a restrictive manner.

It is expressly provided that all combinations of the elements that perform the same function substantially the same way to achieve the same results are within the scope of the invention. Substitution of elements in an embodiment described to another are also fully comprised and contemplated.

It should be also understood that some of the drawings are not necessarily in scale, and are conceptual in nature. The intention is, therefore, to be limited, as indicated by the scope of the attached claims.

The invention claimed is:

1. Process of producing nanofibrillated cellulose and a market pulp characterized by comprising the steps of:

a) cooking and bleaching of biomass generating a cellulosic material comprising a reduced amount of lignin and extractives;

b) separating a fiber line from the cellulosic material, wherein the fiber line comprises fines which are in its totality primary fines, and the fiber line has the following characteristics: b.1) average fiber length of 0.3 to 2.5 mm; and b.2) primary fines content of 3% to 30% by mass of the fiber line;

c) fractionating the separated fiber line of step b) by means of a fractionating system into at least two streams, a high-primary fines content material stream and a low primary fines content pulp stream;

d) separating the high-primary fines content material stream obtained in step c), wherein the high-primary fines content material stream has a content of 10% to 90% of primary fines by mass of the high-primary fines content material stream and consistencies of 0.02% to 1%;

e) thickening the high-primary fines content material stream of step d) until its consistencies reach 2% to 15%;

f) submitting the thickened material of step e) to a nanofibrillated cellulose production process, wherein it is subjected to mechanical refining energy, being the energy consumption used for the generation of the nanofibrillar cellulose smaller than in comparison with non-fractionated or segregated cellulosic pulp starting material;

g) separating the low primary fines content pulp stream of c) which comprises pulp with a °SR reduction of 15% to 50%, and water retention value reduction between 7% and 35% when compared to the cellulosic material; and h) drying of the low primary fines content pulp of step g) in pulp drying machines.

2. Process, according to claim 1, characterized in that the resulting cellulosic material of step a) is selected from bleached cellulose, semi-bleached cellulose, and combinations thereof.

3. Process, according to claim 1, characterized in that step c) is carried out through a fractionating system selected from the group comprising pressurized basket screening systems, fine particulate recovering washers, hydrocyclones and combinations thereof.

4. Process, according to claim 1, characterized in that the refining energy of the nanofibrillated cellulose production process of step f) is associated with enzymatic treatment.

5. Process, according to claim 1, characterized in that the high primary fines content pulp of step d) has °SR between 20 and 95, and water retention values between 140 and 690 percent.

* * * * *